United States Patent [19]

Usher, Jr.

[11] Patent Number: 4,470,599

[45] Date of Patent: Sep. 11, 1984

[54] TENNIS RACKET GRIP

[76] Inventor: Donald K. Usher, Jr., 102 Leonard St., Gloucester, Mass. 01930

[21] Appl. No.: 368,973

[22] Filed: Apr. 16, 1982

[51] Int. Cl.[3] ..... A63B 49/08

[52] U.S. Cl. ..... 273/75

[58] Field of Search ..... 273/73 J, 75, 67 DA, 273/67 DB, 81 R, 81.3, 76, 72 R, 81 B, 81 D, 81.4; D21/212, 211, 210; 145/61 R; 16/110 R, DIG. 12; 7/167; 74/551.9, 543, 557

[56] References Cited

U.S. PATENT DOCUMENTS

| | | | |
|---|---|---|---|
| 1,828,109 | 9/1928 | Fox | 273/73 J |
| 2,205,578 | 6/1940 | Schnur | 273/75 |
| 4,116,440 | 9/1978 | Takeshima | 273/81 B |
| 4,183,528 | 1/1980 | An | 273/75 |

*Primary Examiner*—Richard C. Pinkham
*Assistant Examiner*—Matthew L. Schneider
*Attorney, Agent, or Firm*—Wolf, Greenfield & Sacks

[57] ABSTRACT

A grip for a racket for tennis and other similar games which includes relatively flat faces on one side for engagement with the thumb and fingers and a rounded or elliptical face disposed on the opposite side of the grip from the flat faces for engagement with the palm of the hand. Corners at the intersection of the flat faces provide control of the racket while the rounded portion nestles in the palm for a comfortable and secure gripping of the racket to prevent rotation thereof. The same grip may be used either for a forehand or backhand position and either for a left handed or right handed person, merely by inversion of the racket.

11 Claims, 6 Drawing Figures

TENNIS RACKET GRIP

FIELD OF THE INVENTION

This invention relates generally to hand grips for hand held implements and more particularly to grips for rackets for use in tennis, badminton, squash, paddle-ball and other like games.

BACKGROUND OF THE INVENTION

Rackets for use in tennis, badminton, paddle ball, squash, raquetball and other such games include a flat hitting portion, an elongated neck and a handle which usually is formed on an extension of the neck. The hitting portion is usually strung and includes two parallel faces. The handle portion of the racket includes a grip which the hand engages and which is of critical importance to the player in determining the skill with which he may use the racket. The size, feel and comfort of the grip is important as well as the ease with which it may be held in a proper orientation with respect to the plane of the stroke, so that the user has complete control of where the ball is hit and the type of spin imparted thereto.

Conventional rackets, particularly tennis rackets, are generally provided with an octagonally shaped grip, whether they be formed of metal, glass or wood. Such rackets are generally symmetric about a plane drawn through the handle which is parallel to the racket face. The grip size or the circumference of the grip is typically adjusted by varying the thickness of the grip only in a direction transverse of the racket face. Such alterations are produced by increasing the transverse thickness of the handle an equal amount on each side of the plane parallel to the racket face so that the handle always remains symmetric with respect to this plane. The thickness of the grip in a direction parallel to the racket face normally remains unchanged and the basic octagonal shape of the grip is always maintained.

In most rackets, the handle is formed as an extension of the throat, and a grip is provided by adhering pallets to the lateral sides of the handle parallel to the racket face. The grip size is thus adjusted by adjusting of the thickness of these pallets transversely of the racket face. For a wooden racket, wooden pallets are used and for metal or fiberglass rackets, plastic pallets are often used. The pallets are typically trapezoidal in shape, with the large flat base resting against the throat extension to produce the octagonally shaped grip desired. The pallets and handle are then wrapped with a conventional material such as leather, to provide a gripping surface. In use, one flat surface rests parallel to the racket face against the palm of the hand while the opposite flat surface parallel to the racket face is gripped by the thumb and forefingers.

Since the grip does not conform to the shape of the palm, the flat surfaces thereof primarily rest in contact with the heel of the palm and with an area at the base of the index finger. The fleshy portion of the palm only loosely engages the grip and is not in a comfortable, secure relation therewith.

Grips of such conventional rackets have a tendency to twist in the hand as the racket face strikes the ball if the ball is not struck directly in the center of the racket face. This twisting motion or torque must be resisted by the grip provided by the thumb and forefingers against the heel of the palm and base of the index finger. Since the fleshy part of the palm does not securely engage the grip, it does not assist appreciably in resisting this rotational motion.

SUMMARY OF THE INVENTION

The present invention concerns an improved grip for hand held implements such as rackets which are used in games such as tennis, badminton, squash and paddle-ball in which an object is struck to propel it. The grip of this invention is non-symmetrical about a plane parallel to the racket face, providing a rounded portion which is disposed on the side of the racket handle opposite the forehand hitting surface of the racket and which is configured to reside within the fleshy portion of the palm of the hand. The portion of the racket handle on the same side of the racket as the forehand hitting face is provided with angularly disposed, flat surfaces adapted to be gripped by the thumb and forefingers. The rounded portion of the grip may be enlarged with respect to the forehand portion and it permits a secure and comfortable grasp of the handle. This is because the grip is in close contact with the fleshy portion of the palm of the hand and conforms more closely to the shape thereof, and a greater portion of the hand is in more secure contact with the grip. Thus, not all of the force is placed on the heel but is distributed along the length of the palm. As a result, there is less likelihood of twisting of the racket when striking a ball or other object.

This rounded, asymmetrical configuration may be provided either by machining a wooden handle to the desired shape or by the use of pallets having the desired configuration. The grip size may be varied merely by increasing or decreasing the thickness only of the enlarged portion normal to the plane of the racket face, or by varying the relative normal thickness of both pallets.

DESCRIPTION OF THE DRAWING

The objects, advantages and features of this invention will be more clearly appreciated from the following detailed description taken in conjunction with the accompanying drawing in which.

DETAILED DESCRIPTION OF THE PREFERRED EMBODIMENT

Figure 1:
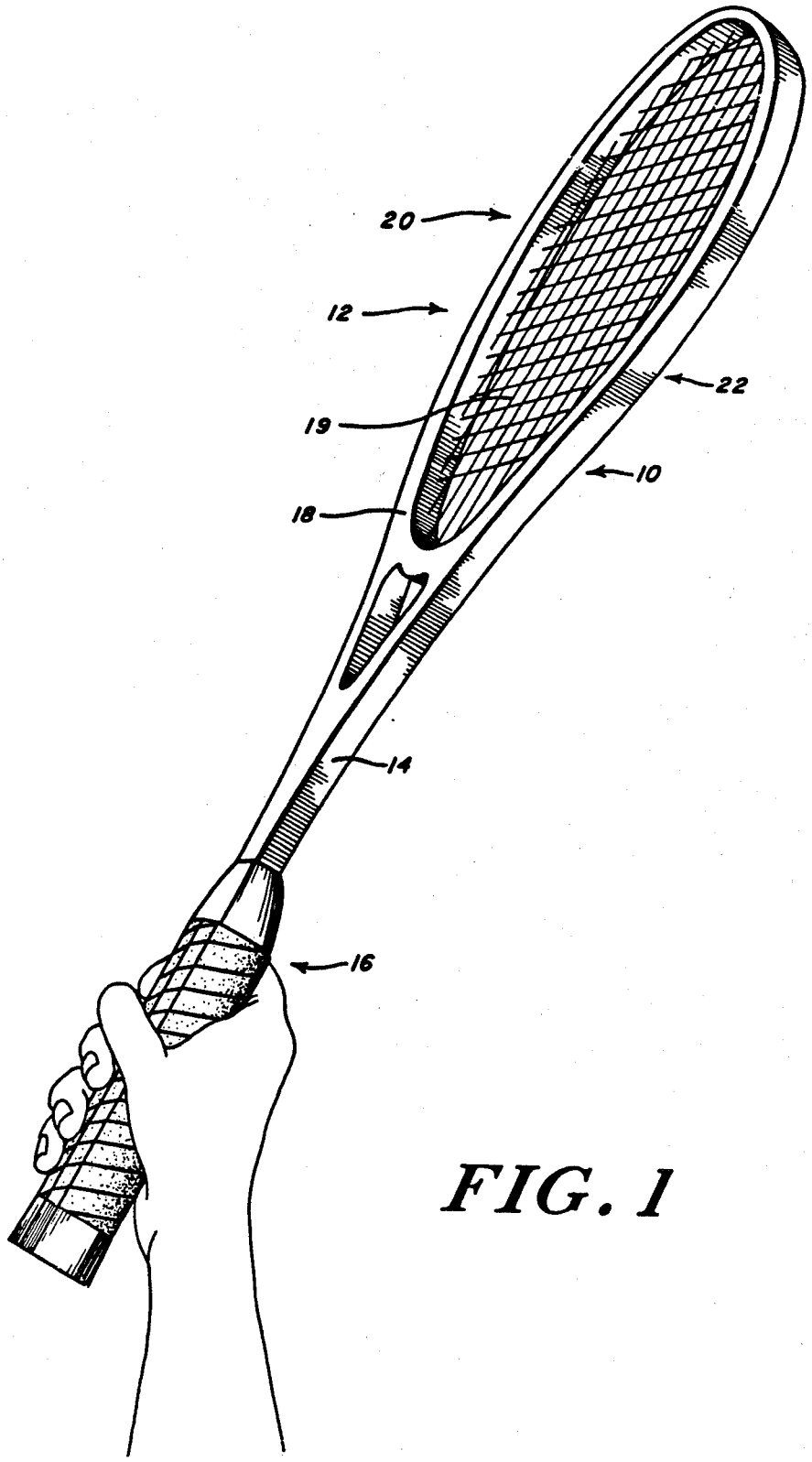
FIG. 1 is a pictorial view showing the racket of this invention being gripped by a user.
Figure 3:
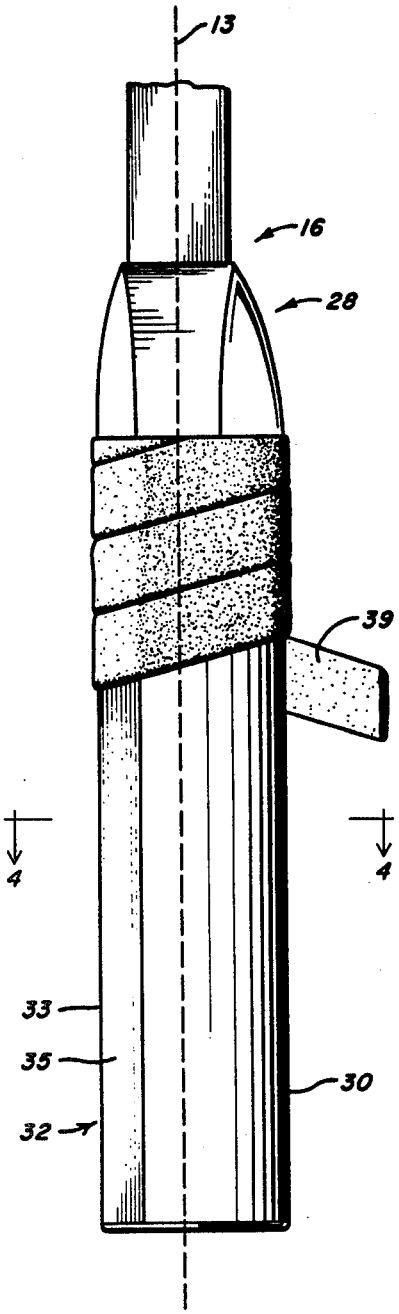
FIG. 3 is a partial view of the grip of FIG. 1.

A hand held racket for use in games including tennis, badminton, raquetball and paddle is exemplified by tennis racket 10 of FIG. 1. Racket 10 includes a head 12, a throat 14, and a handle 16. A typical head 12 includes an oval frame 18 and strings 20 tightly strung in a criss-cross pattern on frame 18 for striking and propelling an object such as a ball. Frame 18 and throat 14 may be formed of any suitable material such as wood or a metal such as aluminum. The racket is gripped with the hand at handle 16, as shown. The racket head 12 has two parallel, planar faces, either of which may be used to strike the ball for propelling it. Front face 20 is used to strike the ball on a forehand shot while rear face 22 is used to strike the ball on a backhand shot. Faces 20 and 22 are often aligned generally perpendicularly of the ground during use and lie in a plane which is usually generally perpendicular to the direction of movement of the racket when striking a ball. The palm of the user's hand is on the same side of the racket as rear face 22 while the fingers and thumb of the hand wrap around the handle to be disposed generally on the same side of the racket as front face 20.

Figure 2:
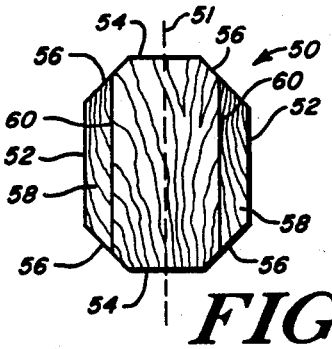
FIG. 2 (PRIOR ART)
FIG. 2 is a cross-sectional view of a handle of a prior art metal racket.

With reference to FIG. 2, a prior art racket grip 50 will be described. This prior art grip 50 is generally symmetrically disposed about a plane 51 parallel to front or forehand face 20 and rear face or backhand face 22 so that either side of the head of such a racket can serve as the front face or the rear face by rotation of the racket 180°. Grip 50 of a typical racket handle has a generally octagonal cross-sectional shape with flat faces 52 generally parallel to the plane of faces 20 and 22, flat faces 54, generally perpendicular to the plane of faces 20 and 22 and four flat faces 56 intersecting with and angularly disposed with respect to faces 52 and 54. In typical prior art rackets, such as that shown in FIG. 2, faces 52 and 56 are formed on trapezoidal pallets 58 which are secured to surfaces 60 on the handle extending from the throat which are generally parallel to the plane of faces 20 and 22. Faces 54 are formed on the lateral sides of the handle extension itself. Both pallets 58 are of the same identical size and shape so that the grip 50 is completely symmetrical about a plane 51. The circumference or size of the grip is changed merely by varying the thickness of each pallet 58 normal to plane 51. The thickness of each pallet 58 is normally changed the same amount so that at no time is one pallet larger than the other. The width of each face 54 is generally never altered.

Grip 50 is engaged so that the thumb and fingers wrap around it and press against faces 52 and 56 on the same side of the racket as front face 20. Faces 52 and 56 on the same side as rear face 22 are pressed primarily against the heel of the hand and portions of the palm at the base of the index finger. The fleshy portion of the palm does not securely engage faces 52, 54 or 56 and this results in an uncomfortable and insecure grasping of grip 50, because of the uneven distribution of force applied by the palm on the grip. As a result, such rackets are subject to rotation if the ball does not strike very close to the center of head 12, because of the applied torque.

With reference to FIGS. 3–6, the unique features of this invention will be described. Handle 16 of racket 10 is provided with a grip 28 which is asymmetrical with respect to a plane 13 parallel to faces 20 and 22 and which includes rearwardly disposed or backhand portion 30 and forwardly facing or forehand portion 32. Portion 30 is provided with a rounded or partially elliptical cross-sectional configuration, and portion 30 may also be enlarged and be provided with a greater thickness normal to plane 13 than portion 32. Portion 32 includes three angularly disposed faces, face 33 disposed generally parallel to plane 13 and two faces 35 forming acute angles with respect thereto. Portion 30 is configured to reside in the fleshy part of the palm of the hand of the user, as shown in FIG. 1, while portion 32 is configured to be gripped by the fingers and thumb of the user along faces 33 and 35 in a conventional manner. In the racket of this invention, one racket face, that associated with portion 32 will always serve as the front face, and the other racket face, that associated with portion 30, will always serve as the rear face. The racket cannot be rotated 180° during use, but rotation is limited to adjustments for the backhand and forehand grips. In either the backhand or forehand positions, rearwardly facing portion 30 always resides within the palm comfortably, so that pressure is applied not only by the heel of the hand but also by the fleshy part of the palm. This rounded configuration of portion 30 provides a more comfortable grip since the force and weight of the racket is more evenly distributed along the palm, and the gripping action is also more secure since a greater portion of the hand is in firm contact with grip 28. The position of the thumb and forefinger can be adjusted on faces 33 and 35 as desired.

The grip size or circumference of the grip of the handle of this invention is typically changed only by changing the thickness normal to plane 13 of portion 30. Portion 32 generally retains the same normal thickness for all grip sizes. However, the grip size can also be changed by varying the normal thickness of both portions 30 and 32 so long as the relative difference in thickness and configuration between them is maintained.

In a typical racket of this invention, the handle is wrapped with a conventional leather or foam material 39 to provide the desired frictional grip of the racket handle, as shown in FIG. 2.

Figure 6:
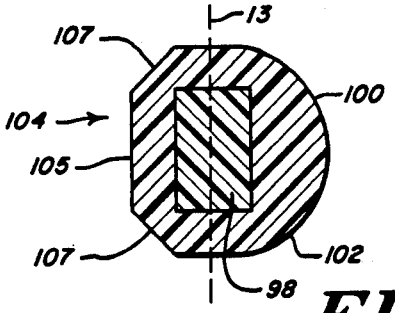
FIG. 6 is a cross-sectional view of a grip of another embodiment of this invention.
Figure 4:
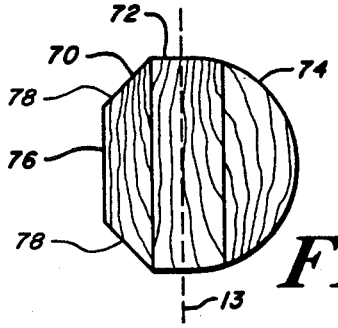
FIG. 4 is a cross-sectional view taken along the line 4—4 of FIG. 3 showing a grip of a wooden racket of this invention.
Figure 5:
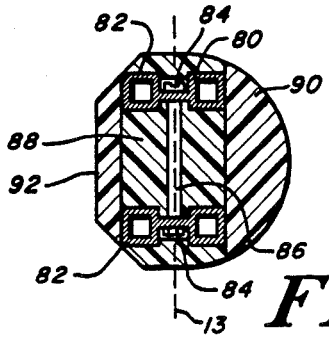
FIG. 5 is a cross-sectional view of a grip of a metal racket of this invention.

Specific embodiments of this invention are shown in FIGS. 4, 5 and 6 for rackets of different compositions. A typical wooden racket handle is illustrated in cross-section in FIG. 4. The handle includes an extension 72 of the throat or a shaft, a front pallet 70 and a rear pallet 74. Extension 72 and pallets 70 and 74 are all composed of some variety of wood. Front pallet 70 has a generally trapezoidal cross-sectional shape, while rear pallet 74 has a generally semi-circular or semi-elliptical cross-sectional shape. Extension 72 has a generally rectangular cross-sectional shape, and is elongated generally parallel to plane 13. The width of each pallet 70 and 74 is equal to the width of extension 72 parallel to plane 13 and remains constant for all grip sizes. The grip size preferably is changed only by varying the thickness of pallet 74 normal to plane 13. The greater the grip size, the more oval or elliptical pallet 74 becomes, while the smaller the grip size the more closely the cross-section of pallet 74 approaches an arc of a circle. Pallet 70 is provided with a front face 76 parallel to plane 13 and angularly disposed side faces 78, similar to those found in prior art rackets. Rounded portion of pallet 74 is adapted to reside in the palm of the user, and the fingers and thumb normally wrap about faces 76 and 78 in a manner which is comfortable to the user, as previously described. The wooden handle of FIG. 4 may also be formed of a unitary piece of wooden stock which has been machined or cut to the desired configuration and size. In all other respects, this embodiment is the same as that of FIGS. 1 and 3.

A cross-sectional view of an aluminum handle 81 of this invention is illustrated in FIG. 5. A rectangular aluminum frame 80 elongated parallel to plane 13 extends through the center of the handle as an extension of the throat of the racket. Frame 80 is typically comprised of four rectangular aluminum shafts 82 linked together normal to plane 13 by aluminum strips 84 and parallel to plane 13 by bolt 86. Inserted into the area around shafts 82 is fiberglass packing 88 which is molded to provide frame 80 with its rectangular shape. Disposed on either side of packing 88 are rear pallet 90 and front pallet 92. Pallets 90 and 92 are typically comprised of plastic although fiberglass or other materials may be used. Pallets 90 and 92 have the same shape as and are identical in all other respects to pallets 74 and 76 respectively of FIG. 4 and will not be further described.

Another embodiment of the grip of this invention is illustrated in FIG. 6. This embodiment may be utilized in conjunction with either a wooden or aluminum racket. A throat extension 98 or shaft passes through the center of the handle, and extension 98 may be either similar to frame 80 of FIG. 5 or extension 72 of FIG. 4. Disposed about extension 98 is a one-piece grip 100 formed of a resilient, plastic foam. Grip 100 is provided with a rearwardly facing rounded surface 102 and a forwardly facing angular surface 104 having face 105 generally parallel to plane 13 and faces 107 forming acute angles with respect to face 105. Faces 105 and 107 are identical to faces 76 and 78 of FIG. 4 and will not be further described. The outer portion of surface 102 is spaced a greater distance from extension 98 than is face 105, to provide the non-symmetrical shape previously described. Surface 102 is adapted to rest in the palm of the hand, while surfaces 105 and 107 are adapted to be grasped by the fingers and thumb. Typically, extension 98 is rectangular or square in shape to prevent rotation thereof within grip 100, although extension 98 may be provided with a triangular hexagonal, octogonal shape as well.

Pallets 74 and 76 are typically composed of wood and may be affixed to the handle in any suitable manner, such as with glue or by utilizing screws countersunk into the wood. Pallets 90 and 92 may also be composed of either wood or fiberglass or of some other suitable material and may be secured either by adhesion or by the use of countersunk screws. Grip 100 is typically composed of a plastic foam such as polyurethane and is typically glued to extension 98.

Modifications and improvements will occur within the scope of this invention, and the above description is intended as exemplary only. The scope of this invention is defined solely by the following claims.

What is claimed is :

1. A hand held sporting implement comprising:

a generally planar racket face;

a generally straight handle secured to said racket face and extending therefrom; and a grip disposed on an end of said handle spaced from said racket face, said grip comprising:

a front portion disposed on one side of said racket face and being comprised of no more than three flat, angularly disposed external gripping surfaces, said gripping surfaces being adapted to be engaged by the thumb and fingers of a hand of a user;

a pair of lateral surfaces disposed generally normally of said racket on opposite sides of said handle; a distance between said lateral surfaces defining a width of said handle and a rear portion disposed on a side of said racket face opposite of said front portion and having a continuous, smoothly curved external gripping surface extending across the entire width of said handle from one of said lateral surfaces to the other, said rear portion being adapted to reside in the palm of the hand of the user.

2. A sporting implement as recited in claim 1 wherein said rear portion has a thickness measured normally to said racket face greater than the thickness of said front portion measured normally to said racket face.

3. A sporting implement as recited in claim 1 wherein said rear portion has a semi-elliptical cross-sectional configuration.

4. A sporting implement as recited in claim 1 wherein said rear portion has a generally semi-circular cross-sectional configuration.

5. A sporting implement as recited in claim 1 wherein said front portion has a generally trapezoidal cross-sectional configuration.

6. A sporting implement as recited in claim 1 wherein a normal thickness of said front portion transverse of said racket face is a fixed, predetermined value and a normal thickness of said rear portion transverse of said racket face is related to the desired grip size.

7. A sporting implement as recited in claim 1 wherein said front portion comprises a first pallet having a trapezoidal cross-sectional shape and said rear portion comprises a second pallet having a partial elliptical cross-sectional shape, said first and said second pallets being secured to said handle.

8. A sporting implement as recited in claim 7 wherein said first and said second pallets are formed of wood.

9. A sporting implement as recited in claim 7 wherein said first and said second pallets are formed of a plastic foam.

10. A sporting implement as recited in claim 7 wherein said first and said second pallets are formed of a molded plastic material.

11. A hand held sporting racket comprising:

a generally planar racket face;

a generally straight handle secured to said racket face and extending from said racket face generally parallel thereto, said handle comprising:

a centrally disposed rectangular shaft having a width extending generally parallel to said racket face;

a front pallet secured to said shaft and disposed on one side of said racket face, said front pallet having a generally trapezoidal cross-sectional configuration and having three, flat, angularly disposed external gripping surfaces adapted to be engaged by the thumb and fingers of the hand of a user;

a rear pallet secured to said shaft and disposed on a side of said racket face opposite of said front pallet, said rear pallet having a generally partially-elliptical cross-sectional configuration, said rear pallet having a thickness normal to said racket face greater than the thickness of said front pallet normal to said racket face, said rear pallet having a continuous, curved, external surface adapted to reside in the palm of the hand of a user and extending across the entire width of said shaft; and gripping material covering external surfaces of said front pallet, said rear pallet and said shaft.

* * * * *